United States Patent [19]

Wagoner

[11] Patent Number: 5,036,995

[45] Date of Patent: Aug. 6, 1991

[54] PERIPHERAL SEAL FOR FLOATING TANK COVER

[75] Inventor: Robert B. Wagoner, Broken Arrow, Okla.

[73] Assignee: 501 Matrix Service, Inc., Tulsa, Okla.

[21] Appl. No.: 552,799

[22] Filed: Jul. 13, 1990

[51] Int. Cl.[5] ..... B65D 88/46

[52] U.S. Cl. ..... 220/224; 220/222; 220/216

[58] Field of Search ..... 220/216, 218, 221, 222, 220/224

[56] References Cited

U.S. PATENT DOCUMENTS

| | | | |
|---|---|---|---|
| 2,634,017 | 4/1953 | Moyer | 220/222 |
| 2,737,310 | 3/1956 | Ulm | 220/222 |
| 2,784,863 | 3/1957 | Fabian | 220/224 |
| 2,801,763 | 8/1957 | Ulm | 220/224 |
| 2,855,122 | 10/1958 | Ulm et al. | 220/224 X |
| 2,888,161 | 5/1959 | Springer | 220/224 |
| 2,897,998 | 8/1959 | Ulm | 220/224 |
| 2,960,252 | 11/1960 | Ulm | 220/224 |
| 4,154,359 | 5/1979 | Bissett | 220/222 |
| 4,397,399 | 8/1983 | Wagoner | 220/220 X |
| 4,540,104 | 9/1985 | Kawai et al. | 220/222 X |

*Primary Examiner*—Stephen Marcus
*Assistant Examiner*—Vanessa M. Roberts
*Attorney, Agent, or Firm*—Head & Johnson

[57] ABSTRACT

A rim space sealing device comprising a peripheral sealing ring of over-lapped shoe segments attached to a floating cover within a storage tank. Spring loaded hanger-pushers and horizontal springs keep the peripheral sealing ring of shoe segments pressed against the tank wall and also keep the floating cover centered within the tank. The space between the peripheral sealing ring of shoe segments and the floating cover is covered by a flexible fabric that prevents product loss. Vertical movement of the individual shoe segments over each other is prevented by a series of circumferentially arranged rods. The over-lap of the shoe segments is restricted by a series of bars forming expansion-contraction spaces.

31 Claims, 4 Drawing Sheets

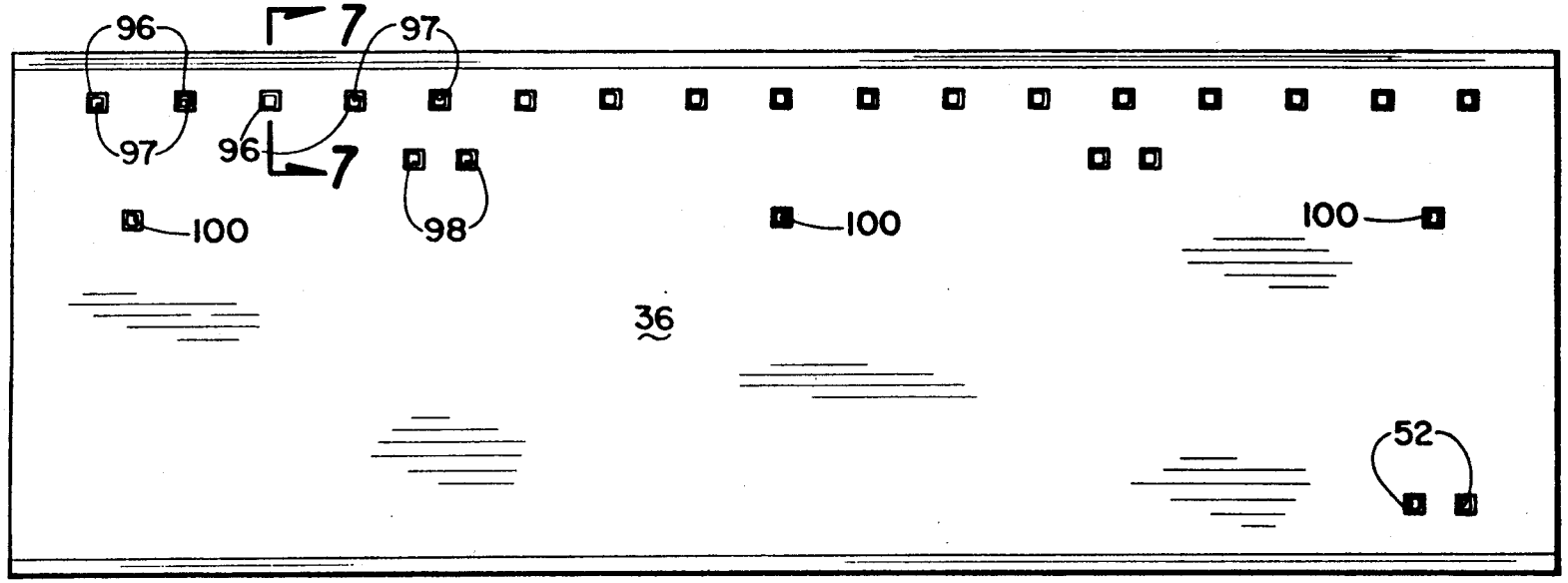
Fig. 9
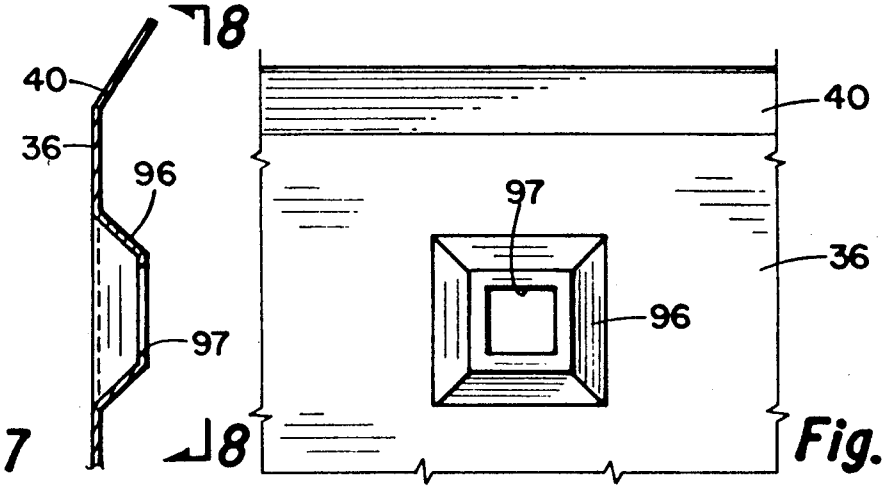
Fig. 8
Fig. 7
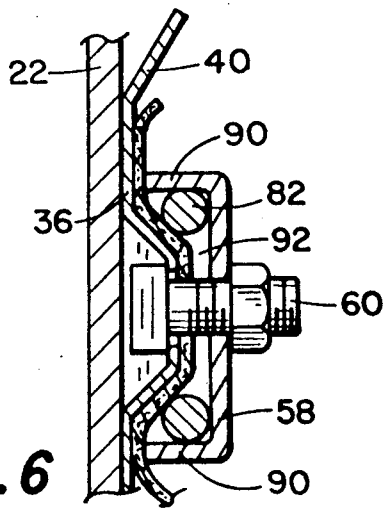
Fig. 6

PERIPHERAL SEAL FOR FLOATING TANK COVER

BACKGROUND OF THE INVENTION

1. Field of the Invention

This invention relates to improvements in sealing devices for the rim space between the inner wall of a storage tank and the periphery of a floating cover therein.

2. Description of the Prior Art

Bulk fluids such as petroleum and fuel products are usually stored in large cylindrical tanks. These are commonly designed with floating covers to minimize product losses to the atmosphere. A critical part of the floating cover is the sealing mechanism that is installed in the annular space (rim space) between the floating cover and the inner wall of the storage tank. This sealing mechanism is designed to allow the floating roof to float on the stored product, to maintain a vapor seal, to move easily within the tank as the product levels rise and fall, and to keep the floating cover centered within the tank.

The sealing ring, or shoe type seal, has proven over the years to be the most effective type of sealing device. The shoe type seal consists of a sealing ring that completely encircles the inner periphery of the storage tank wall. This sealing ring is formed of segments that overlap. This configuration allows for expansion and contraction of the sealing ring segment joints. The most common methods of expansion joints are (1) the use of flexible fabric at every 3-5 shoe segments that is riveted or bolted to the shoe segment, and (2) the use of a metal expansion joint that is formed into the shoe segment. The metal expansion joints allow expansion and contraction that allow gaps or openings that exceed accepted gap criteria and promote product loss and environmental pollution.

SUMMARY OF THE INVENTION

This invention discloses a means for sealing the (this is termed the "rim Space") space between a floating cover and the tank wall in bulk fluid storage. A series of overlapping flexible shoe segments are disposed around the periphery of the storage tank in moveable contact with the inner wall of the storage tank. A series of horizontal springs and of spring loaded hanger-pusher bars attached to the edge of the floating cover and to the ring of shoe segments keeps the cover centered and also serves to keep the shoe segments pressed against the tank wall and also supports the shoe segments to keep them aligned with the cover. Vertical movement of the lapped shoe segments with relation to each other is limited by an upper and lower inward bend of the shoe segments, and by a series of moveable rods which allow horizontal, but not vertical, movement. Horizontal movement is limited by a series of retaining bars on the edge of each shoe covering the area of overlap. The space between the ring of lapped shoe segments and the edge of the floating cover is covered by an annular ring of flexible material fastened near the top of the shoe segments and on the edge of the cover.

Some of the advantages of the disclosed device here are a decrease in field labor costs and in shop fabrication costs. The design allows for a continuous sealing ring without local gaps, and provides expansion-contraction capability which allows the sealing ring to follow irregular contours of the tank wall. Maintenance is decreased since there is no need to replace a fabric or expansion joint or a cover for a metallic joint.

BRIEF DESCRIPTION OF THE DRAWINGS

FIG. 6 is a detailed cross-sectional side view taken along the line 6—6 of FIG. 11 of the tank wall with shoe with attached upper fabric clip illustrating the countersunk configuration of the shoe and the placement of the retainer rods.

FIG. 7 is a cross-sectional side view taken along the line 7—7 of FIG. 9 of a countersunk area in the shoe segment.

FIG. 8 is a frontal view taken along the line of 8—8 of FIG. 7 of a countersunk area in the shoe segment.

FIG. 9 is a frontal view of one of the shoe segments with all countersunk areas shown.

DETAILED DESCRIPTION OF THE PREFERRED EMBODIMENT

Figure 1:
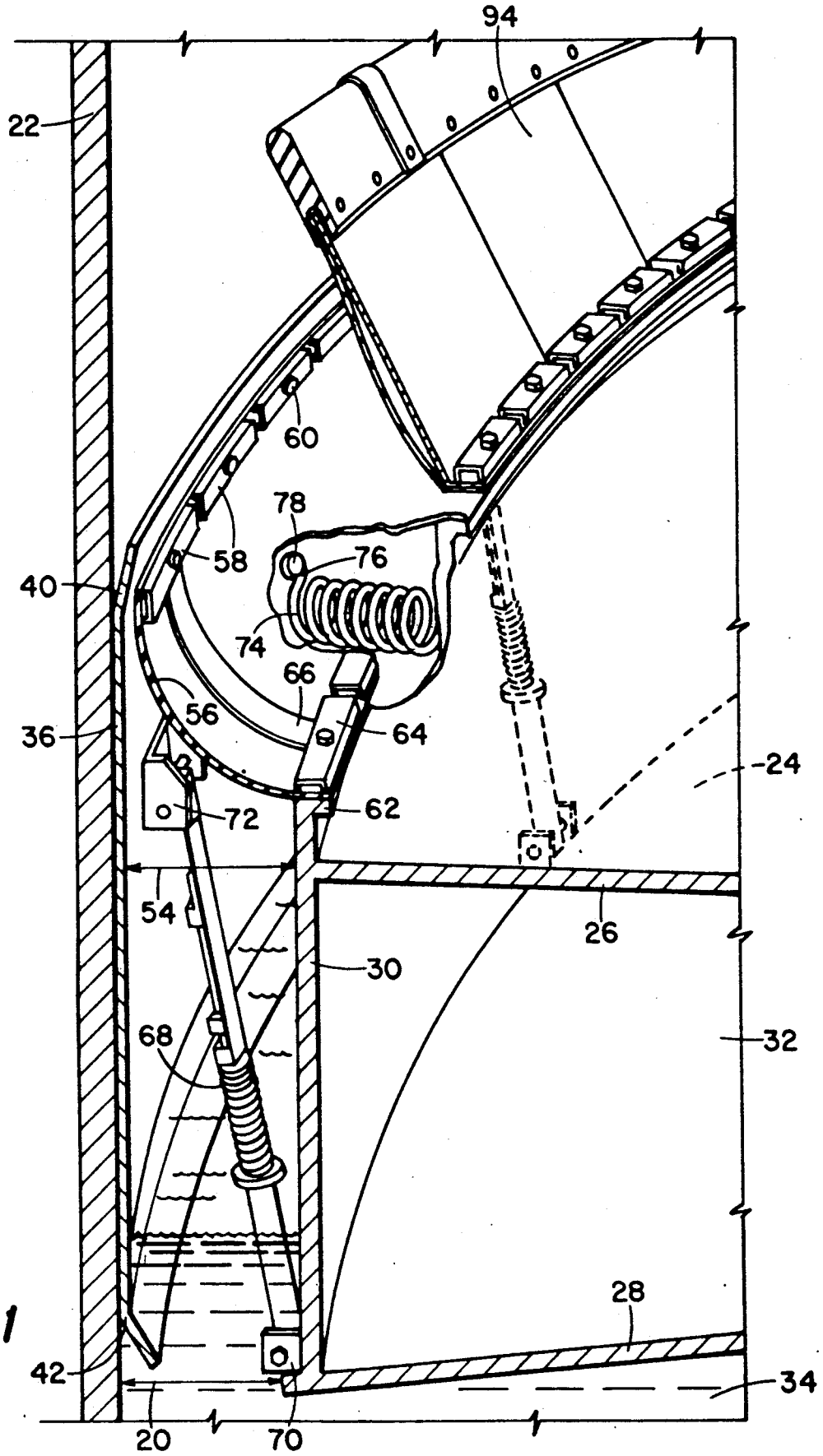
FIG. 1 is a cut away side view with partial sectional view of the storage tank with floating roof and sealing device in place.

This is a device for sealing the rim space 20 between a tank wall 22, and a floating cover 24. The floating cover 24 typically has a top plate 26, a bottom plate 28, and an outer wall 30 enclosing an airspace 32, or other means of buoyancy, such that the cover 24 floats on the liquid contents 34 of a storage tank, as illustrated in FIG. 1.

A series of flexible shoes 36 are disposed around the periphery of the tank wall 22 and are frictionally engaged with the wall 22. Shoes 36 may be made of metal or other suitable flexible material that is non-reative with the storage contents. In the preferred embodiment, shoes 36 are made of stainless steel or of galvanized sheet. The shoes 36 are lapped 38 (best seen in FIGS. 10 and 11) at approximately 10 to 12 foot intervals to form a sealing ring that completely encircles the inner circumference of the tank wall 22. Larger or smaller shoe segments may be used. The top edge of each shoe segment 36 is bent inward 40 as is the bottom edge 42 which allows the sealing ring of shoe segments 36 to slide up and down the inner tank wall 22 without the edges catching on imperfections or irregularities in the contour of tank wall 22. The inward bends 40 and 42 also provide a means of controlling the vertical movement of the overlapping shoe segments 36 and 38 on each other. In the preferred embodiment, each shoe segment 36 is 10 to 12 feet long, 3 to 4 feet high, and has an overlap 38 of about 6 inches. These measurements may be varied and are not to be taken as restrictions.

Figure 10:
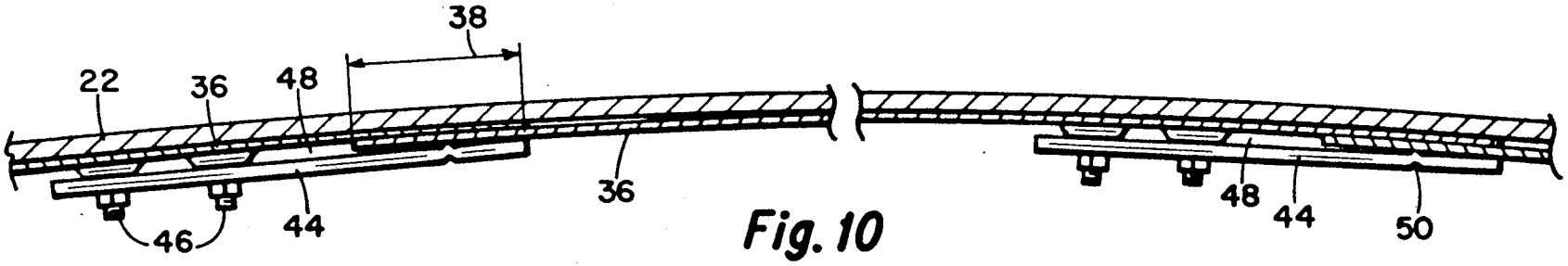
FIG. 10 is a top-sectional view taken along the line 10—10 of FIG. 11 of the tank wall with overlapping shoe segments and retention plate shown.
Figure 11:
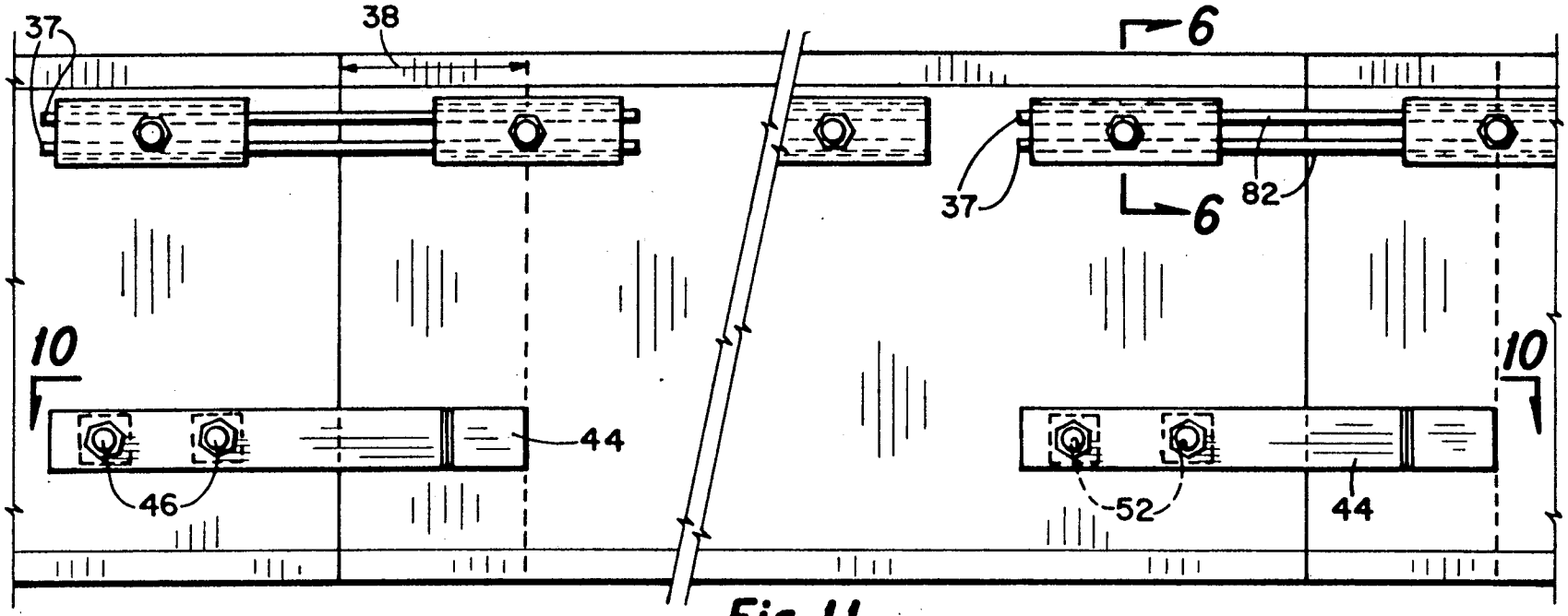
FIG. 11 is a frontal view of overlapping shoe segments showing areas of overlap, fabric clips with retainer rods, and retention plate.

FIGS. 10 and 11 illustrates the areas of shoe 36 overlap 38 and a series of one or more retention plates 44 at the edge of each shoe segment 36 which are bolted 46 (or otherwise attached) to the shoe 36 so as to create an expansion-contraction space 48 between the retention plate 44 and the shoe 36 which defines the area of expansion and contraction of the adjacent shoe overlap. In the preferred embodiment, a six inch overlap is anticipated. A shim or crimp 50 is placed in each of the retention plates 44 to provide pressure on the underlying shoe 36 forcing the two overlapping shoe segments 38 together and thus forming a no-gap flexible joint. The retention plates 44 may be attached to the shoe 36 near the lower edge of the shoe 36 as illustrated in FIGS. 9 and 11.

Figure 3:
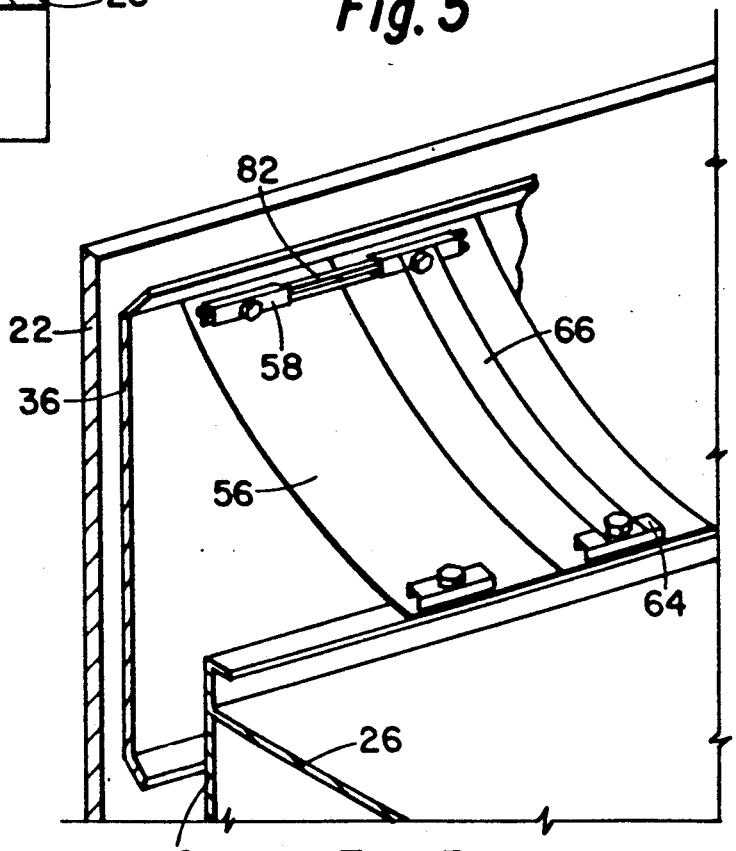
FIG. 3 is a tangential cross-section of the tank, floating cover and sealing device in place, with static strip and retainer rods in place.

The space 54 between the sealing ring of shoe segments 36 and the outer wall of the floating cover 30 is sealed by flexible material 56, which may be fabric, plastic, or other suitable material best seen in FIGS. 1 and 3. The outer edge of the flexible material 56 is fastened near the upper inward bend 40 of the shoe plates 36 by a series of upper fabric clips 58. The upper fabric clips 58 are attached to the shoes 36 by bolts 60, or other fastening means. The inner edge of the flexible material 56 is connected to a rim plate 62 on the upper edge of the outer wall 30 of the floating cover 24. Connection to this plate 62 is made by a series of lower fabric clips 64. Periodically, strips of conductive material are attached between the upper fabric clips 58 and the lower fabric clips 64 to form static drain strips 66. The strips of flexible material 56 may be fastened together (not shown) by any suitable means such as adhesive, clips, and the like.

Figure 2:
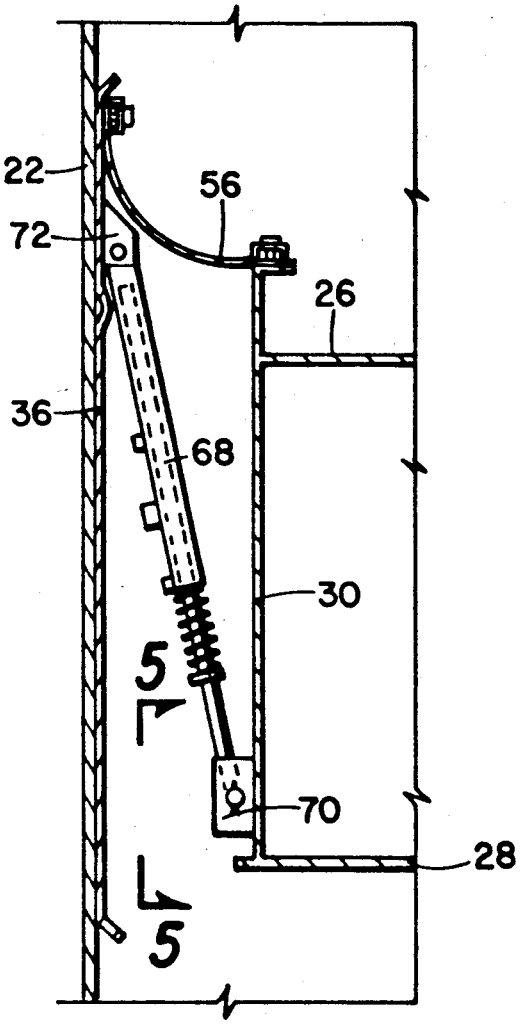
FIG. 2 is a cross-sectional view showing the floating cover, spring-loaded hangerpusher, shoes, tank wall and fabric cover.
Figure 4:
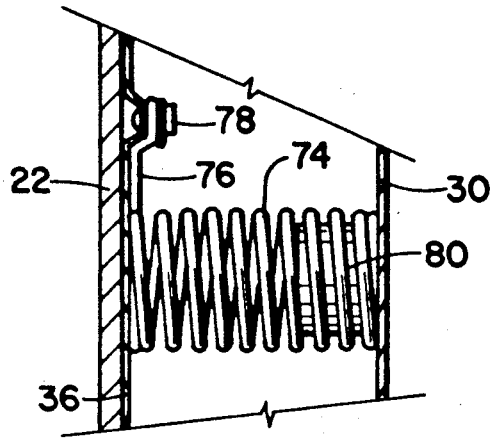
FIG. 4 is a side-view of the horizontal spring pusher.
Figure 5:
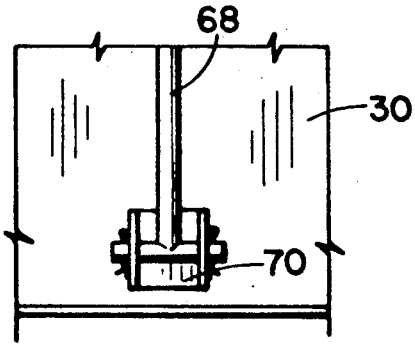
FIG. 5 is a detailed view taken along the line 5—5 of FIG. 2 of the pivot housing of the spring loaded hangerpusher device.

The sealing ring of shoe segments 36 is urged outward and upward by a series of spring loaded hanger pushers 68 which are attached to the lower edge of the outer wall 30 of the floating cover 24 by a pivot housing 70, best seen in FIGS. 2 and 5. The upper end of the spring loaded hanger pusher 68 is attached to the shoe 36 by a shoe hanger bracket 72. This arrangement of spring loaded hanger pushers 68 keeps the sealing ring of shoes 36 in frictional contact with the tank wall 22 and also keeps the ring of shoes 36 in vertical alignment with the floating cover 24. Further outward pressure on the sealing ring of shoe segments 36 may be maintained by a series of horizontal pusher springs 74 which extend horizontally between the outer wall of the floating cover 30 and the shoe segments 36, best seen in FIGS. 1 and 4. The attachment of the spring 74 to the shoe 36 may be accomplished by a pigtail attachment 76 to a bolt, or other fastening means, 78 in the shoe segment 36. The other end of the spring 74 is fastened to the outer wall of the floating cover 30 by a pin 80 or other means.

As mentioned previously, vertical movement of the shoe segments 36 is limited in the areas of overlap 38 by the upper 40 and lower 42 inward bends in the shoe segments 36. As a further means of limiting the vertical movement of the overlapping shoe segments 38 in relation to each other, a series of retainer rods 82 are placed around the circumference of the inner surface of the shoes 36. The means of holding these rods 82 is best illustrated in FIG. 6. The upper fabric clip 58 has two legs 90 which form a space 92 between the leg 90, the bolt 60, and the underlying flexible material 56 and shoe 36. It is within space 92 that rods 82 are movably retained. In the preferred embodiment, a plurality of rods 82 are used. Each overlap area 38 has two rods 82 placed so as to extend for the length of the overlap area 38 plus added length for retention in the upper fabric clips 58 on each side of the overlap 38. Thus the length extends from the edge 37 of the fabric clip 58 through the clip 58, across the overlap 38 and through the next clip 58 to its end 37. The sequence is repeated at the next overlap 38. The rods 82 may be formed of steel, or other suitable material, and should be of sufficient size to fit snugly within the fabric clip 58 space 92, but allowing horizontal movement when the overlap 38 expands or contracts.

In addition to preventing vertical slippage of the shoes 36 over each other, rods 82 also help to keep flexible material 56 pressed against shoe 36. When there is contraction of the ring of shoes 36, the overlying flexible material 56 may tend to "pucker" and rods 82 help to correct this.

Additional sealing may be accomplished by adding a second sealing device 94, as illustrated in FIG. 1, attached to the rim plate 62 of the floating cover 24 (the illustrated seal 94 is taken from U.S. Pat. No. 4,397,399 of Wagoner issued on 08/09/1983). Other types of seals may be used.

FIG. 9 illustrates one of the shoe segments 36 with countersunk areas and holes 97 for upper fabric clip 58 bolts 60. A second array of countersunk areas and holes 98 is present for attaching the shoe bracket 72 of the spring-loaded hanger-pusher 68. A third series of holes 100 and countersunk areas is present for attaching the pigtails 76 of the springs 74 by bolts 78. Finally, holes 52 and countersunk areas are provided for attaching retention plates 44 to shoe 36 by bolts 46. FIG. 7 illustrates a cross-sectional side view of the countersunk area 96 and hole 97 for the upper fabric clip 58. FIG. 8 illustrates the same area in a frontal view. The countersunk areas 96 and holes 97, 98, 100, 52 provide a smooth surface on the reverse of the shoe segments 36 so there is no interference with the sliding of the shoes 36 on the tank wall 22. Finally, it should be noted that the elevation provided by the countersunk area around hole 52 for the retention plates 44, provides spacing 48 between shoe segment 36 and retention plate 44 to receive the next shoe segment 36. If additional spacing is required, spacers may be used.

The claims and the specification describe the invention presented and the terms that are employed in the claims draw their meaning from the use of such terms in the specification. The same terms employed in the prior art may be broader in meaning than specifically employed herein. Whenever there is a question between the broader definition of such terms used in the prior art and the more specific use of the terms herein, the more specific meaning is meant.

While the invention has been described with a certain degree of particularity it is manifest that many changes may be made in the details of construction and the arrangement of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A device for sealing the rim space between a floating cover, movably disposed within a storage tank, and the inner wall of the storage tank, comprising:

a peripheral sealing ring formed of lapped shoe segments;

means for holding said shoe segments against the inner wall of said storage tank;

at least one bar fastened to the edge of each shoe segment forming an expansion-contraction space for limiting the horizontal movement of overlapping edges of said lapped shoe segments with respect to each other;

means for limiting vertical movement of individual shoe segments with respect to each other; and means for covering the space between said peripheral sealing ring of lapped shoe segments and the outer edge of said floating cover.

2. A device, as recited in claim 1, wherein said shoe segments are formed of galvanized sheet metal.

3. A device, as recited in claim 1, wherein said means for holding said sealing ring of shoe segments against said inner wall of said storage tank and for centering said floating cover, is a spring-loaded hanger-pusher assembly attached at one end to said floating cover and at the other end to one of said shoe segments.

4. A device, as recited in claim 1, wherein said means for holding said sealing ring of shoe segments against said tank wall and for centering said floating cover, is a series of horizontal pusher springs attached at one end to said floating cover and at the other end to one of said shoe segments.

5. A device, as recited in claim 1, wherein said means for limiting vertical movement of individual shoe segments with respect to each other includes an upper and a lower inward bend of the top and bottom of each shoe segment, respectively, thus restraining vertical movement.

6. A device, as recited in claim 1, wherein said means for limiting vertical movement of individual shoe segments with respect to each other includes a series of moveable rods circumferentially attached to each shoe segment and overlapping the edges of each shoe segment preventing vertical movement between adjacent shoe segments.

7. A device, as recited in claim 1, wherein said means for covering the space between said peripheral sealing ring of lapped shoe segments and the outer edge of said floating cover is a flexible material.

8. A device, as recited in claim 7, wherein said flexible material is fabric.

9. A device, as recited in claim 7, wherein said flexible material is fastened to the upper edge of the inner edge of the peripheral sealing ring of shoe segments and to the outer edge of said floating cover forming a continuous impervious seal.

10. A device, as recited in claim 9, wherein said flexible material is fastened by a series of fabric clips to the lapped shoe segments.

11. A device, as recited in claim 9, wherein said flexible material includes static drains disposed on said flexible material so as to ground said floating cover.

12. A device for sealing the rim space between a floating cover, movably disposed within a storage tank, and the inner wall of the storage tank, comprising:

a peripheral sealing ring formed of lapped shoe segments;

means for holding said shoe segments against the inner wall of said storage tank;

means for limiting the horizontal movement of overlapping edges of said lapped shoe segments with respect to each other;

a series of moveable rods circumferentially attached to each said shoe segment and overlapping the edges of each segment for limiting vertical movement of individual shoe segments with respect to each other; and means for covering the space between said peripheral sealing ring of lapped shoe segments and the outer edge of said floating cover.

13. A device, as recited in claim 12, wherein said shoe segments are formed of galvanized sheet metal.

14. A device, as recited in claim 12, wherein said means for holding said sealing ring of shoe segments against said inner wall of said storage tank and for centering said floating cover, is a spring-loaded hanger-pusher assembly attached at one end to said floating cover and at the other end to one of said shoe segments.

15. A device, as recited in claim 12, wherein said means for holding said sealing ring of shoe segments against said tank wall and for centering said floating cover, is a series of horizontal pusher springs attached at one end to said floating cover and at the other end to one of said shoe segments.

16. A device, as recited in claim 12, wherein said means for limiting said horizontal movement of overlapping edges of said lapped shoe segments is at least one bar fastened to the edge of each shoe segment forming an expansion-contraction space for the overlapping portion of the adjacent shoe segment.

17. A device, as recited in claim 12, wherein said means for limiting vertical movement of individual shoe segments with respect to each other includes an upper and a lower inward bend of the top and bottom of each shoe segment, respectively, thus restraining vertical movement.

18. A device, as recited in claim 12, wherein said means for covering the space between said peripheral sealing ring of lapped shoe segments and the outer edge of said floating cover is a flexible material.

19. A device, as recited in claim 18, wherein said flexible material is fabric.

20. A device, as recited in claim 18, wherein said flexible material is fastened to the upper edge of the inner edge of the peripheral sealing ring of shoe segments and to the outer edge of said floating cover forming a continuous impervious seal.

21. A device, as recited in claim 20, wherein said flexible material is fastened by a series of fabric clips to the lapped shoe segments.

22. A device, as recited in claim 20, wherein said flexible material includes static drains disposed on said flexible material so as to ground said floating cover.

23. A device for sealing the rim space between a floating cover, movably disposed within a storage tank, and the inner wall of the storage tank, comprising:

a peripheral sealing ring formed of lapped shoe segments;

means for holding said shoe segments against the inner wall of said storage tank;

means for limiting the horizontal movement of overlapping edges of said lapped shoe segments with respect to each other;

means for limiting vertical movement of individual shoe segments with respect to each other; and flexible material fastened to the upper edge of the inner edge of said peripheral sealing ring of shoe segments and to the outer edge of the floating cover forming a continuous impervious seal providing means for covering the space between said peripheral sealing ring of lapped shoe segments and the outer edge of said floating cover, said flexible material includes static drains disposed on said flexible material so as to ground said floating cover.

24. A device, as recited in claim 23, wherein said shoe segments are formed of galvanized sheet metal.

25. A device, as recited in claim 23, wherein said means for holding said sealing ring of shoe segments against said inner wall of said storage tank and for centering said floating cover, is a spring-loaded hanger-pusher assembly attached at one end to said floating cover and at the other end to one of said shoe segments.

26. A device, as recited in claim 23, wherein said means for holding said sealing ring of shoe segments against said tank wall and for centering said floating cover, is a series of horizontal pusher springs attached at one end to said floating cover and at the other end to one of said shoe segments.

27. A device, as recited in claim 23, wherein said means for limiting said horizontal movement of overlapping edges of said lapped shoe segments is at least one bar fastened to the edge of each shoe segment forming an expansion-contraction space for the overlapping portion of the adjacent shoe segment.

28. A device, as recited in claim 23, wherein said means for limiting vertical movement of individual shoe segments with respect to each other includes an upper and a lower inward bend of the top and bottom of each shoe segment, respectively, thus restraining vertical movement.

29. A device, as recited in claim 23, wherein said means for limiting vertical movement of individual shoe segments with respect to each other includes a series of moveable rods circumferentially attached to each shoe segment and overlapping the edges of each shoe segment preventing vertical movement between adjacent shoe segments.

30. A device, as recited in claim 23, wherein said flexible material is fabric.

31. A device, as recited in claim 23, wherein said flexible material is fastened by a series of fabric clips to the lapped shoe segments.

* * * * *

UNITED STATES PATENT AND TRADEMARK OFFICE

CERTIFICATE OF CORRECTION

PATENT NO. : 5,036,995

DATED : August 6, 1991

INVENTOR(S) : Wagoner, Robert B.

It is certified that error appears in the above—identified patent and that said Letters Patent is hereby corrected as shown below:

ON THE TITLE PAGE: Item [73]
delete "501"

Signed and Sealed this

Tenth Day of November, 1992

*Attest:*

DOUGLAS B. COMER

*Attesting Officer*

*Acting Commissioner of Patents and Trademarks*